US007307455B2

(12) United States Patent
Choi et al.

(10) Patent No.: US 7,307,455 B2
(45) Date of Patent: Dec. 11, 2007

(54) BUFFER AND ORGANIC LIGHT EMITTING DISPLAY AND A DATA DRIVING CIRCUIT USING THE BUFFER

(75) Inventors: Sang Moo Choi, Suwon-si (KR); Yong Sung Park, Seoul (KR); Yang Wan Kim, Seoul (KR)

(73) Assignee: Samsung SDI Co., Ltd. (KR)

( * ) Notice: Subject to any disclaimer, the term of this patent is extended or adjusted under 35 U.S.C. 154(b) by 66 days.

(21) Appl. No.: 11/390,774

(22) Filed: Mar. 28, 2006

(65) Prior Publication Data

US 2006/0220942 A1 Oct. 5, 2006

(30) Foreign Application Priority Data

Mar. 31, 2005 (KR) ..... 10-2005-0027305
Mar. 31, 2005 (KR) ..... 10-2005-0027306

(51) Int. Cl.
*H03K 19/0175* (2006.01)
*H03K 19/094* (2006.01)

(52) U.S. Cl. ..... 326/82; 326/86; 327/109

(58) Field of Classification Search ..... 326/82–83, 326/86; 327/108–109
See application file for complete search history.

(56) References Cited

U.S. PATENT DOCUMENTS 4,781,437 A 11/1988 Shields et al.
5,465,058 A * 11/1995 Krenik et al. ..... 326/83
5,734,366 A 3/1998 Kubota et al.
6,498,596 B1 12/2002 Nakamura et al.
6,961,054 B2 * 11/2005 Matsumoto ..... 345/204

FOREIGN PATENT DOCUMENTS

JP 2004-004241 1/2004
JP 2005-045677 2/2005

OTHER PUBLICATIONS

The International Search Report issued by the European Patent Office on Oct. 11, 2006.

* cited by examiner

*Primary Examiner*—Vibol Tan
*Assistant Examiner*—Jason Crawford
(74) *Attorney, Agent, or Firm*—Knobbe Martens Olson & Bear LLP

(57) ABSTRACT

A buffer and organic light emitting display with data driving circuit using the buffer is provided. A buffer comprises a first capacitor for receiving an analog voltage; a first inverter having an input terminal connected to the first capacitor; a second inverter having an input terminal connected to an output terminal of the first inverter through a second capacitor; a third capacitor connected to an output terminal of the second inverter; a first transistor for controlling a current which flows from a first power source to a data line so that the buffer output voltage is supplied to the data line in response to a control signal supplied to the third transistor which is connected between the data line and the first capacitor.

26 Claims, 8 Drawing Sheets

BUFFER AND ORGANIC LIGHT EMITTING DISPLAY AND A DATA DRIVING CIRCUIT USING THE BUFFER

CROSS-REFERENCE TO RELATED APPLICATIONS

This application claims the benefit of Korean Patent Application Nos. 2005-27305 and 2005-27306, filed on Mar. 31, 2005, in the Korean Intellectual Property Office, the disclosure of which is incorporated herein by reference.

BACKGROUND

1. Field of the Invention

The present invention relates to a buffer and organic light emitting display and a data driving circuit using the buffer, particularly to a buffer and organic light emitting display and a data driving circuit using the buffer that are able to provide an accurate output voltage regardless of the threshold voltage of a transistor.

2. Discussion of Related Technology

Various flat-panel displays have been developed so as to have less weight and bulk than that of a CRT (Cathode Ray Tube). Flat-panel displays include liquid crystal displays, electric field emission displays, plasma display panels, and organic light emitting displays, as well as others. An organic light emitting display presents an image using organic light emitting diodes that emit light from the recombination of electrons and holes. The organic light emitting display creates a data signal using input data from an outside source and displays an image having a desired brightness by supplying the generated data signal to pixels using at least a data driving circuit and data lines.

The data driving circuit converts the input data into a voltage corresponding to a gray scale value and supplies the converted voltage to data lines as a data signal via a buffer. Each respective pixel receives an electrical current corresponding to the voltage from the driving circuit. As a result, the organic light emitting diode within each pixel emits light according to the current it receives and a predetermined image is displayed.

In the above mentioned data driving circuit, the buffer should supply the data signal to a pixel without a voltage drop between its input and output. However, conventional buffers supply a data signal with a voltage drop corresponding to a threshold voltage of a transistor. Because of this, the voltage of the data signal is dropped by as much as a transistor threshold voltage and the result is that pixels are not able to display the image with a desired brightness.

SUMMARY OF CERTAIN INVENTIVE EMBODIMENTS

Accordingly, an aspect of certain embodiments is to provide a buffer which does not produce an output with a transistor threshold drop.

One embodiment has a buffer including a first capacitor including first and second capacitor terminals, the first capacitor being configured to receive an analog voltage on the first capacitor terminal, where the analog voltage is an input to the buffer, a first inverter having a first input terminal and a first output terminal, the first input terminal being connected to the second capacitor terminal of the first capacitor, a second capacitor having a third capacitor terminal connected to the first output terminal of the first inverter, and a fourth capacitor terminal, a second inverter having a second input terminal and a second output terminal, the second input terminal being connected to the fourth capacitor terminal of the second capacitor, a third capacitor having a fifth capacitor terminal connected to the second output terminal of the second inverter, and a sixth capacitor terminal, a first transistor connected to the sixth capacitor terminal of the third capacitor, the first transistor being configured to control a flow of a current from a first power source to a data line such that a buffer voltage is supplied to the data line, where the first transistor is configured to control the current in response to a voltage supplied from the third capacitor, and a second transistor connected to the data line and to the first terminal of the first capacitor.

Another embodiment has a data driving circuit including a digital to analog converter configured to generate an analog voltage in response to a bit value of a data input, and a plurality of buffers each buffer configured to supply the analog voltage to a data line, each buffer including a first capacitor including first and second capacitor terminals, the first capacitor being configured to receive an analog voltage on the first capacitor terminal, where the analog voltage is an input to the buffer, a first inverter having a first input terminal and a first output terminal, the first input terminal being connected to the second capacitor terminal of the first capacitor, a second capacitor having a third capacitor terminal connected to the first output terminal of the first inverter, and a fourth capacitor terminal, a second inverter having a second input terminal and a second output terminal, the second input terminal being connected to the fourth capacitor terminal of the second capacitor, a third capacitor having a fifth capacitor terminal connected to the second output terminal of the second inverter, and a sixth capacitor terminal, a first transistor connected to the sixth capacitor terminal of the third capacitor, the first transistor being configured to control a flow of a current from a first power source to a data line such that a buffer voltage is supplied to the data line, where the first transistor is configured to control the current in response to a voltage supplied from the third capacitor, and a second transistor connected to the data line and to the first terminal of the first capacitor.

BRIEF DESCRIPTION OF THE DRAWINGS

These and/or other aspects and advantages of certain embodiments will become apparent and more readily appreciated from the following description, taken in conjunction with the accompanying drawings of which.

Figure 1:
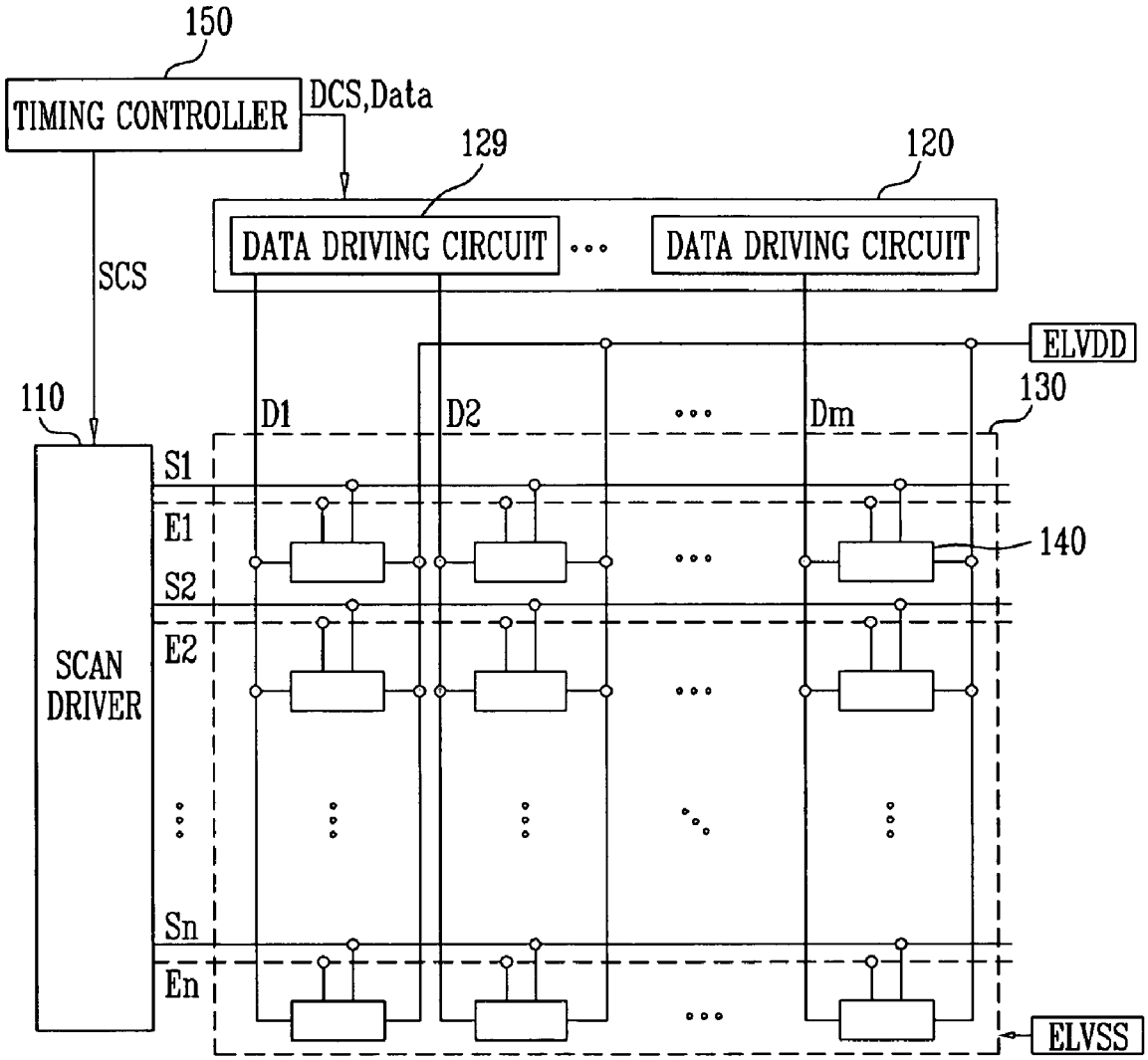
FIG. 1 is a schematic diagram illustrating an organic light emitting display according to one embodiment.

The following Examples are given for the purpose of illustration and are not intended to limit the scope of this invention.

DETAILED DESCRIPTION OF CERTAIN EMBODIMENTS

Hereinafter, certain embodiments will be described with reference to the accompanying drawings. When one element is connected to another element, the one element may be not only directly connected to the other element but may also be indirectly connected to the other element via a third element. Further, some elements are omitted for clarity. Also, like reference numerals refer to like elements throughout.

FIG. 1 illustrates an organic light emitting display according to the present invention. Referring to FIG. 1, an organic light emitting display in accordance with one embodiment includes a pixel portion 130 which has pixels 140 formed in an array with a plurality of scan lines S1 through Sn and a plurality of data lines D1 through Dm, a scan driver 110 configured to drive the scan lines S1 through Sn, a data driver 120 configured to drive the plurality of data lines D1 through Dm and a timing controller 150 configured to control the scan driver 110 and the data driver 120.

The scan driver 110 generates a scan signal in response to a scan drive control signal SCS from the timing controller 150 and sequentially supplies the generated scan signal to the scan lines S1 through Sn. The scan driver 110 also generates a light emission control signal in response to the scan drive control signal SCS and sequentially supplies the generated light emission control signal to light emitting control lines E1 through En.

The data driver 120 generates data signals in response to a data drive control signal DCS from the timing controller 150 and supplies the generated data signals to the data lines D1 through Dm. The data driver 200 has at least a first data driving circuit 129. The data driving circuit 129 converts input data into a data signal to be driven onto the data lines D1 through Dm. A detailed structure of the data driving circuit 129 will be explained below.

The timing controller 150 generates the data drive control signal DCS and the scan drive control signal SCS. The data drive control signal DCS is supplied to the data driver 120 and the scan drive control signal SCS is supplied to the scan driver 110. The timing controller 150 also supplies input data to the data driver 120.

The pixel portion 130 receives a first power source ELVDD and a second power source ELVSS. The first power source ELVDD and the second power source ELVSS are supplied to respective pixels 140. The pixels 140 receiving the first power source ELVDD and the second power source ELVSS display an image corresponding to the data signal supplied from the data driving circuit 129.

Figure 2:
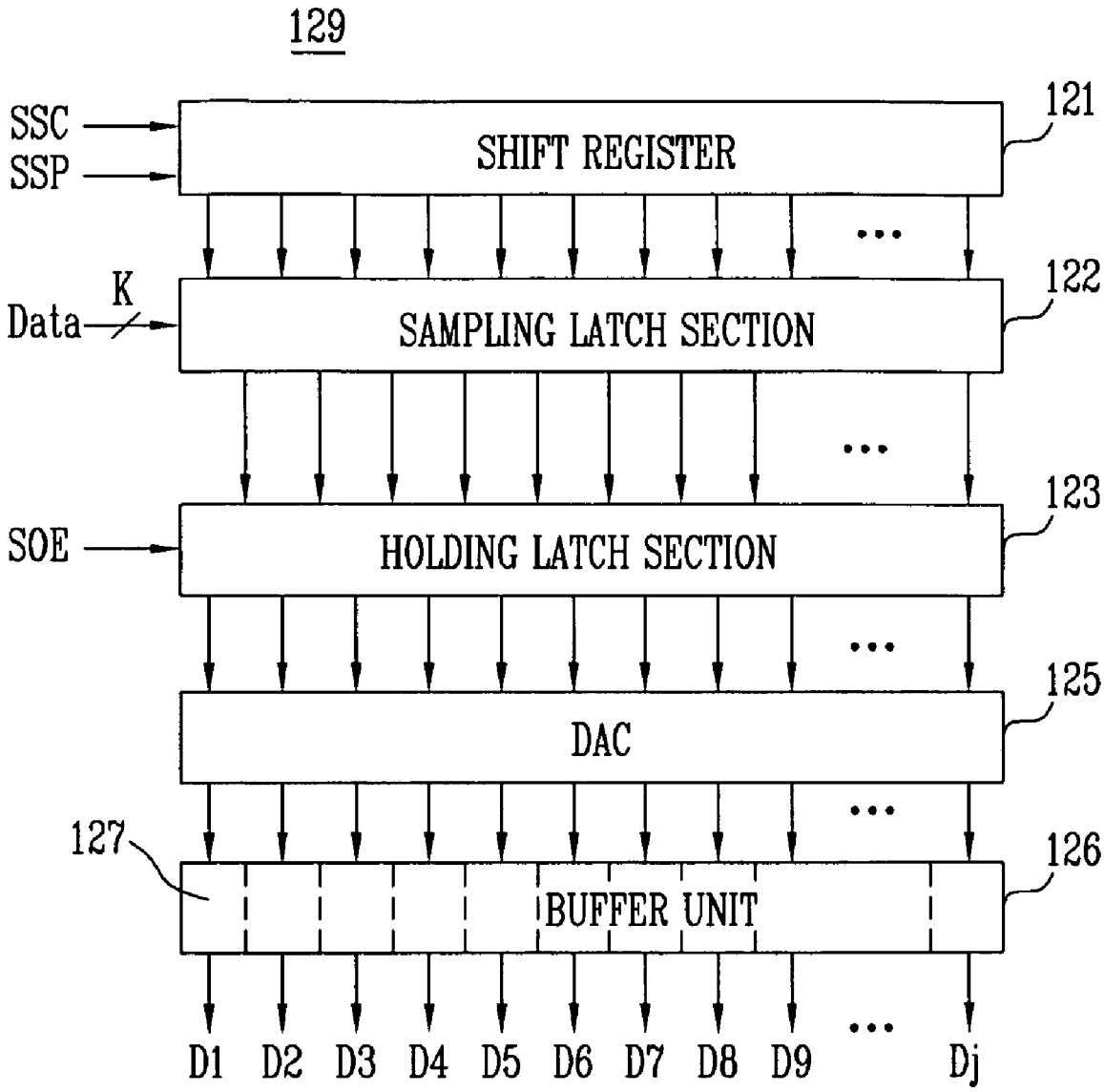
FIG. 2 is a block diagram illustrating an embodiment of a data driving circuit depicted in FIG. 1.

FIG. 2 illustrates a block diagram according to an example embodiment of a data driving circuit depicted in FIG. 1. The data driving circuit in this example includes j (j is a positive integer) data lines and J channels that are able to be connected. Referring to FIG. 2, the data driving circuit 129 comprises a shift register 121 for sequentially generating a sampling signal, a sampling latch section 122 for sequentially storing data in response to the sampling signal, a holding latch section 123 for storing data from the sampling latch section 122 and for supplying the stored data to a digital-analog converter 125 (referred to as a "DAC" hereafter), a DAC 125 for generating an analog voltage corresponding to the data and a buffer unit 126 for supplying the analog voltage to the data lines D.

The shift register 121 receives a source shift clock SSC and a source start pulse SSP from the timing controller 150. After receiving the source start pulse SSP, the shift register 121 generates j sampling signals, one at each period of the source shift clock SSC.

The sampling latch section 122 sequentially stores the data in response to a sampling signal. The sampling latch section 122 has j sampling latches so as to store the data, where each latch has bit-width corresponding to the number of bits in the data. For example, each latches is configured with a size of k bits in the case that the data has k bits.

The holding latch section 123 receives the data from the sampling latch section 122 when a source output enable signal SOE is received from the timing controller 150. After receiving the data, the holding latch section 123 supplies the data stored to DAC 125 when a next source output enable signal SOE is received from the timing controller 150. The holding latch section 123 includes j of holding latches each having a size of k bits.

The DAC 125 generates an analog voltage corresponding to a bit value of the data and supplies the generated voltage to a buffer unit 126.

The buffer unit 126 includes buffers 127 which buffer data signals from the DAC 125 and drive them to j data lines D1 through Dj. For advantageous system performance, the buffers 127 output data signals which are substantially not voltage-dropped to the data lines D1 through Dj regardless of the threshold voltage of the transistors included in the buffers 127.

Figure 3:
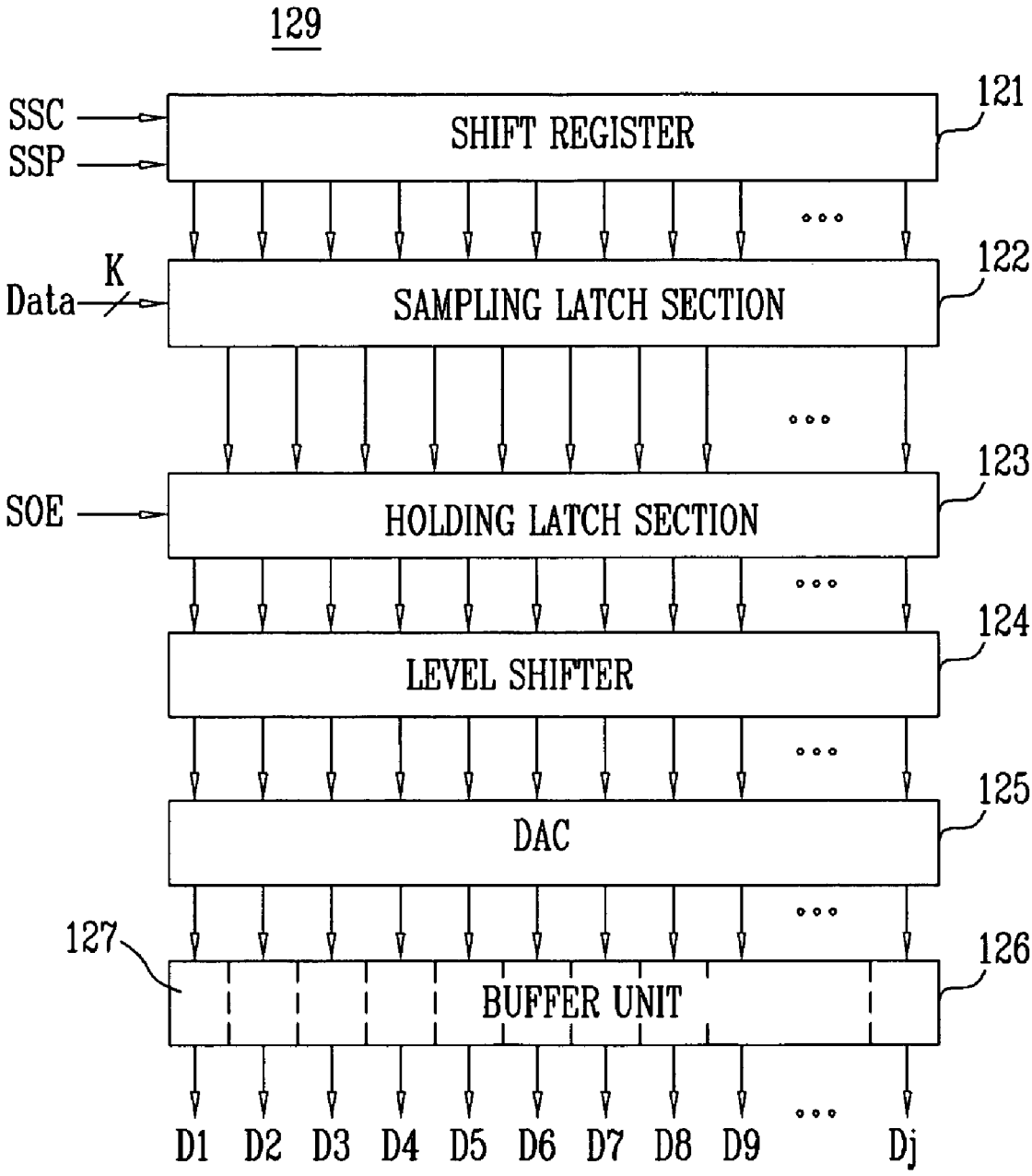
FIG. 3 is a block diagram illustrating another embodiment of a data driving circuit depicted in FIG. 1.

The voltage level of the data before the level shifter 124 is low to reduce power in this digital portion of the circuit. In some embodiments the DAC 125 may be better driven with higher digital voltage levels. As shown in FIG. 3, the data driving circuit 129 may further comprises a level shifter 124 located between the holding latch section 123 and the DAC 125 to increase the voltage level of the data supplied from the holding latch section 123 to the DAC 125.

Figure 4:
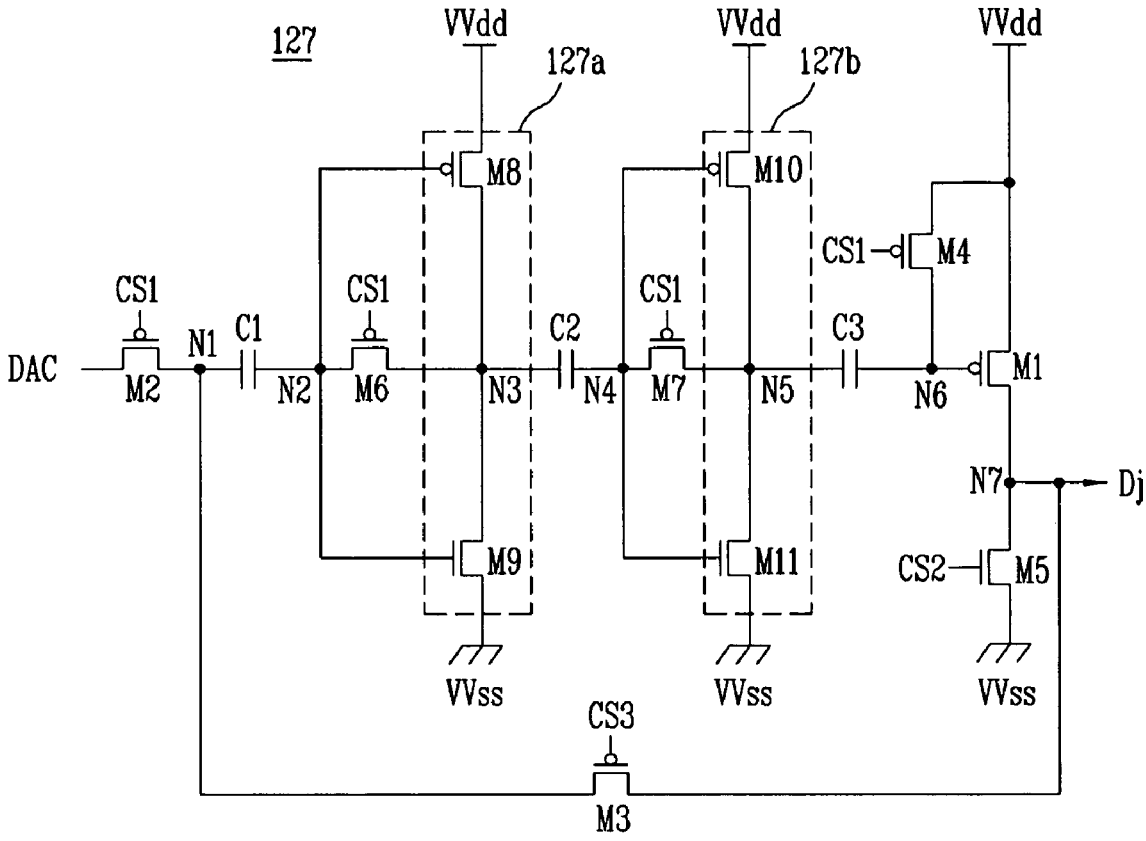
FIG. 4 is a schematic circuit diagram of a structure of a buffer according to an embodiment.

FIG. 4 illustrates a detailed schematic circuit diagram of a buffer according to an example embodiment. The buffer 127 comprises a first inverter 127*a*, a second inverter 127*b*, a first transistor M1 connected between the data line Dj and a third power source VVdd, a second transistor M2 and a first capacitor C1 connected between the DAC 125 and the first inverter 127*a*, a second capacitor C2 connected between the first inverter 127*a* and the second inverter 127*b* and a third capacitor C3 connected between the second inverter 127*b* and the first transistor M1.

The buffer 127 also comprises a transistor M3 connected between the data line DJ and a first node N1 which is a common terminal of the second transistor M2 and the first capacitor C1, a fourth transistor M4 connected between the third power source VVdd and a sixth node N6 which is a common terminal of the third capacitor C3 and the first transistor M1, a fifth transistor M5 connected between the fourth power source VVss and a seventh node N7 which is a common terminal of the first transistor M1 and the data line Dj, a sixth transistor M6 connected between an input terminal N2 and an output terminal N3 of the first inverter 127*a* and a seventh transistor connected between an input terminal N4 and an output terminal N5 of the second inverter 127*b*.

The first transistor M1 controls a current which flows into the seventh node N7 from the third power source VVdd in response to a voltage value supplied to a sixth node N6. The analog voltage at node N7 responds according to the current, and is supplied to a pixel 140 as a data signal. The second transistor M2 supplies an analog voltage from the DAC 125 to the first node N1 when a first control signal CS1 is supplied. The third transistor M3 is on when a third control signal CS3 is supplied, and the seventh node N7 and the first node N1 are electrically connected. This closes the feedback loop by which N7 is controlled. The fourth transistor M4 supplies a voltage of the third power source VVdd to the sixth node N6 when a first control signal CS1 is supplied, thereby turning off transistor M1. The fifth transistor M5 supplies a voltage of the fourth power source VVss to the seventh node N7 (and therefore to data line Dj) when a second control signal CS2 is supplied. The first inverter 127*a* includes an eighth transistor M8 and a ninth transistor M9 which are connected between the third power source VVdd and the fourth power source VVss. From here, the eighth transistor M8 is adjusted by a P-MOS and the ninth transistor M9 is adjusted by an N-MOS.

The gate terminals of the eighth transistor M8 and the ninth transistor M9 and one terminal of the first capacitor C1 are each connected to the second node N2 which is driven in response to a voltage driven on the first node N1. The sixth transistor M6 electrically connects the second node N2 with the third node N3 when the first control signal CS1 is supplied. The second inverter 127*b* includes a tenth transistor M10 and an eleventh transistor M11 which are connected between the third power source VVdd and the fourth power source VVss. From here, the tenth transistor M10 is adjusted by a P-MOS and the eleventh transistor M11 is adjusted by an N-MOS.

The gate terminals of the tenth transistor M10 and the eleventh transistor M11 and one terminal of the second capacitor C2 are connected to the fourth node N4, and are driven in response to a voltage driven on the third node N3. The seventh transistor M7 electrically connects the fourth node N4 with the fifth node N5 when the first control signal CS1 is supplied.

Figure 5:
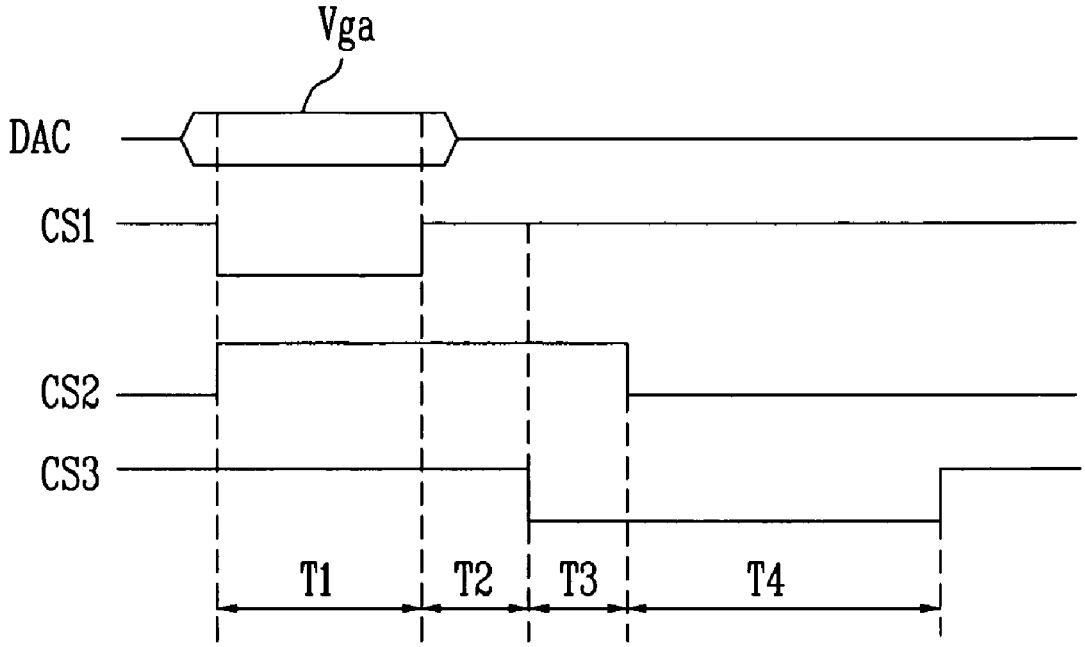
FIG. 5 is a timing diagram showing control signals supplied to the buffer depicted in FIG. 4.

FIG. 5 is a timing diagram showing the DAC signal Vga, and the control signals CS1, CS2, and CS3 for the buffer of FIG. 4 during drive periods T1, T2, T3, and T4. As shown, the first control signal CS1 and the second control signal CS2 are supplied during drive period T1. Accordingly, during drive period T1, the second transistor M2, the sixth transistor M6, the seventh transistor M7, the fourth transistor M4 and the fifth transistor M5 are each on. With transistor M6 on, the first inverter 127*a* will provide a voltage to the second node N2 and the third node N3. The voltage provided will be of a level between the level of the voltage of the fourth power source VVss and the level of the voltage of third power source VVdd. Likewise, with transistor M7 on, the second inverter 127*b* will similarly provide a voltage to the fourth node N4 and the fifth node N5, where the voltage provided will have a level between the level of the voltage on the fourth power source VVss and the level of the voltage on the third power source VVdd. With the second transistor M2 on, an analog voltage Vga is supplied from the DAC 125 to the first node N1. Accordingly, a voltage that corresponds to the difference between the analog voltage Vga and the voltage at the second node N2 is stored across the first capacitor C1.

Furthermore, because the voltage supplied to the second node N2 is always the same, the voltage stored across the first capacitor C1 is based on the analog voltage Vga. With the fourth transistor M4 on, the voltage of the third power source VVdd is supplied to the sixth node N6, and the first transistor M1 is off. Also, the difference between the voltage on the fifth node N5 and the voltage on the sixth node N6, is stored across the third capacitor C3.

Next, the first control signal CS1 is discontinued during the second drive period T2. Accordingly, the second transistor M2, the sixth transistor M6, the seventh transistor M7 and the fourth transistor M4 are off during the second drive period T2. Note that at the end of the second drive period T2, the voltages at the first through fifth nodes N1-N5 are such that the voltage at the sixth node N6 is the same as the third source voltage VVdd. Accordingly, at the end of the second drive period T2, the first transistor M1, is off.

During the third drive period T3, the third control signal CS3 is supplied. Accordingly, the third transistor M3 is on during the third drive period T3, and the seventh node N7 is electrically connected to the first node N1. As the seventh node N7 is driven to the fourth voltage source VVss by the fifth transistor M5, the first node N1 will be driven from the second drive period value of Vga to VVss during the third drive period T3. The value of the voltage at the second node N2 is likewise reduced because of the first capacitor C1 when the voltage of the first node N1 is reduced to VVss. Because the amount of voltage drop at the first node N1 is based on the analog voltage Vga, the voltage drop at the second node N2 will likewise be based on the analog voltage Vga.

As the second node N2 is the input of the first inverter 127*a*, when the voltage at the second node N2 is reduced, the output of the first inverter 127*a*, at the third node N3, will be increased. Because of the second capacitor C2, the voltage at the fourth node N4 will increase according to the increase at the third node N3. As the fourth node N4 is the input of the second inverter 127*b*, when the voltage at the fourth node N4 is increased, the output of the second inverter 127*b*, at the fifth node N5, will be reduced. As the sixth node N6 is capacitively coupled to the fifth node N5, when the fifth node N5 is reduced, the sixth node N6 will similarly be reduced.

Because the sixth node N6 is the gate voltage of the first transistor M1, when the voltage at the sixth node is reduced, the first node turns on and begins to conduct current to the seventh node N7. However, because the fifth transistor M5 is still on, the voltage at node N7 does not substantially change. Note that at the end of the third drive period T3, the voltages at the first through fifth nodes N1-N5 are such that the voltage at the sixth node N6 is lower than the third source voltage VVdd. Accordingly, at the end of the third drive period T3, the first transistor M1, is on.

Next, during the fourth driving period T4, the control signal CS2 is discontinued and the fifth transistor M5 turns off. The voltage at the seventh node N7 rises according to the current supplied from the first transistor M1. Because the voltage at the seventh node is fed back to the first and second inverters 127*a* and 127*b* through the third transistor M3 and the first capacitor C1, the voltage at the sixth node N6 at the input of the first transistor M1 is affected by the rising voltage at the seventh node N7. The voltage at the sixth node is affected in such a way that an increasing voltage at the seventh node N7 causes the voltage at the sixth node N6 to rise. The voltages at the seventh node N7 and at the sixth node N6 will continue to rise until the first transistor M1 turns off. This will occur when the voltage at the seventh node N7 has risen enough to bring the voltages at the first through sixth nodes N1-N6 back to the values these voltages had at the end of the second drive period T2. Recall that at the end of the second drive period T2, the voltage at the sixth node N6 was equal to the value of the power source VVdd, and the first transistor M1 was therefore off. This will again occur when the voltage at the seventh node N7, and therefore the voltage at the first node N1, has risen so as to be equal to the value of the voltage at the first node N1 at the end of the second driving period T2. Recall that the value of the voltage at the first node N1 at the end of the second driving period was the analog voltage Vga. Thus, during the fourth driving period, the buffer will drive the data line Dj with the analog voltage Vga without a transistor threshold voltage drop, and the associated pixel 140 will illuminate according to the accurate voltage.

Figure 6:
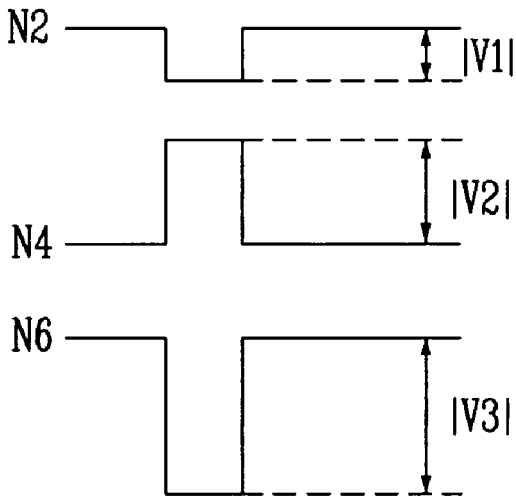
FIG. 6 is a timing diagram showing voltage values of certain nodes of the buffer depicted in FIG. 4.

FIG. 6 shows the transitions of the second, fourth, and sixth nodes N2, N4, and N6 during the second third and fourth driving periods. As described above, at the end of the second driving period, the voltage at the second node N2 has a value based on the first inverter 127*a* with its input and output shorted by the sixth transistor M6. Similarly, the voltage at the fourth node N4 has a value based on the second inverter 127*b* with its input and output shorted by the seventh transistor M7. The voltage at the sixth node N6 has a value equal to the power source VVdd because the sixth node N6 was shorted to the power source VVdd during the first drive period T1 by the fourth transistor M4.

During the third driving period T3, the voltages at the second, fourth, and sixth nodes N2, N4, and N6 transition according to the first set of transitions shown in FIG. 6. The voltage at the second node N2 is reduced by an amount V1, which is based on the analog voltage Vga. The voltage at the fourth node N4 increases based on the increase in the voltage at the third node N3, which is based on the reduction in the voltage at the second node N2 and the gain of the first inverter 127*a*. Note that the voltage at the fourth node N4 increases by more than the amount the voltage at the second node N2 reduces. This occurs because of the gain of the first inverter 127*a*. The voltage at the sixth node N6 decreases based on the decrease in the voltage at the fifth node N5, which is based on the increase in the voltage at the fourth node N4 and the gain of the second inverter 127*b*. Note that the voltage at the sixth node N6 decreases by more than the amount the voltage at the fourth node N4 increases. This occurs because of the gain of the second inverter 127*b*.

During the fourth period, as described above, the voltage at the seventh node N7 is fed back to the first node N1. The rising voltage at the seventh node N7 causes the voltage at the first node N1 to rise. Because of the coupling capacitor between the first and second nodes, the rising voltage at the first node N1 causes the voltage at the second node N2 to also rise. Because of the first inverter 127*a*, the rising voltage at the second node N2 causes the voltage at the third node N3 to reduce. Because of the coupling capacitor between the third and fourth nodes, the reduction in the voltage at the third node N3 causes the voltage at the fourth node N4 to also reduce. Because of the second inverter 127*b*, the reduction in the voltage at the fourth node N4 causes the voltage at the fifth node N5 to increase. Because of the coupling capacitor between the fourth and fifth nodes, the increasing voltage at the fifth node N5 causes the voltage at the sixth node N6 to increase. As described above, once the voltage at the sixth node N6 increases to VVdd, the first transistor will stop driving current to the seventh node N7, and accordingly the seventh node N7 will stop rising. As illustrated in FIG. 6, this occurs when the voltages at the second, fourth and sixth nodes each return to the value of the voltages these nodes had at the end of the second driving period.

Accordingly, an accurate analog voltage Vga from the DAC 125 can be supplied by the buffer 127 to the data line Dj regardless of the transistor threshold voltage. One advantageous aspect of the buffer is that in can be easily used in large displays with high resolution because of the accuracy of the output. Additionally, because of the gain of the two transistors, the voltage presented at the gate of the first transistor is an amplified version of the analog voltage Vga. This results in faster operation of the buffer. In some embodiments the gain may be realized with other circuitry configurations. On the other hand, in some embodiments the gain is not necessary, and the circuitry between the first node N1 and the fifth node N5 may be replaced with a wire or some other substantially unity gain circuit.

Figure 7:
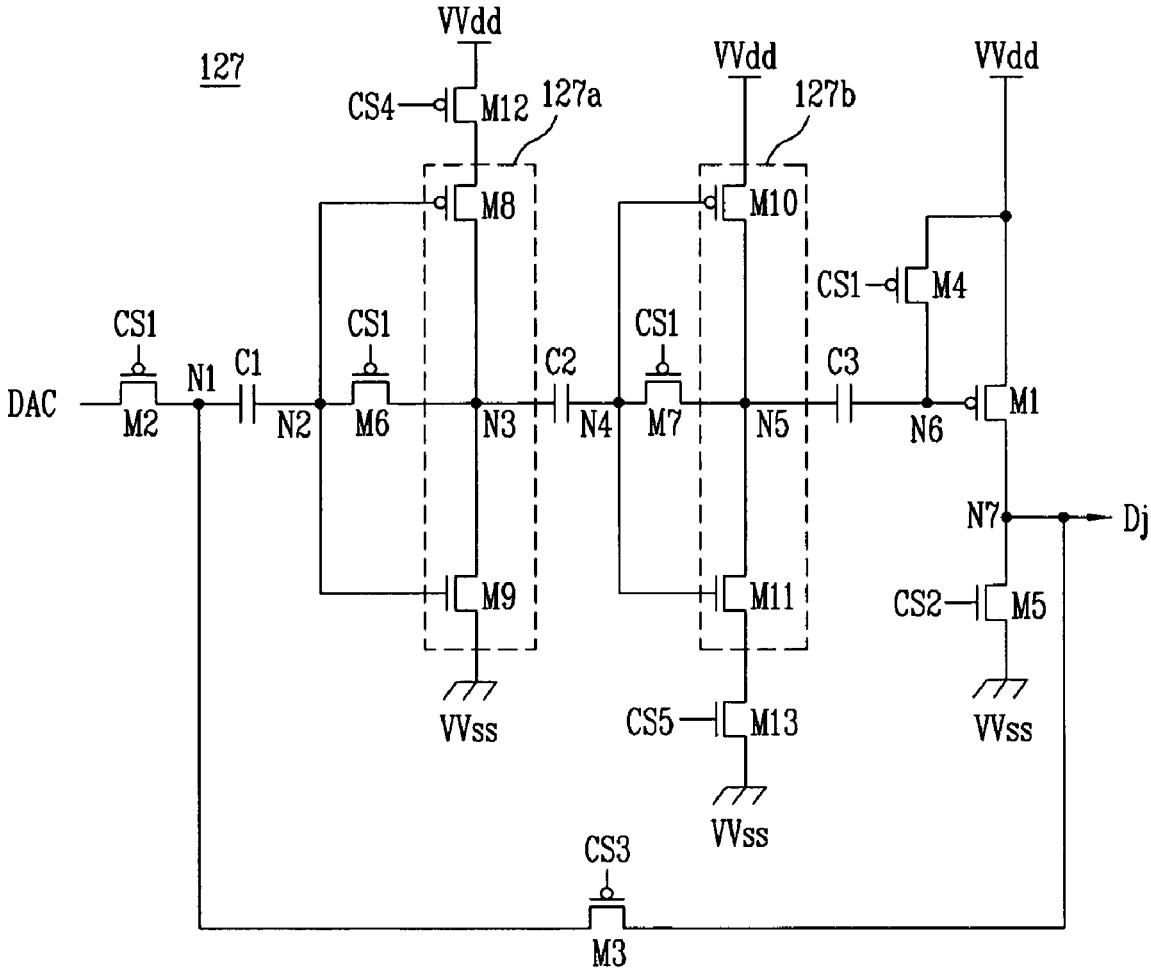
FIG. 7 is a schematic circuit diagram of a structure of a buffer according to another embodiment.

FIG. 7 illustrates a detailed schematic circuit diagram of a structure of a buffer according to another example embodiment. This embodiment differs from the embodiment shown in FIG. 4 by the addition of a twelfth transistor M12 connected with between the first inverter 127*a* and the third power source VVdd and the addition of a thirteenth transistor M13 connected between the second inverter 127*b* and the fourth power source Vvss. The twelfth transistor M12 and the thirteenth transistor M13 are of different conductivity. That is, the twelfth transistor M12 is a PMOS transistor, and the thirteenth transistor M13, is an NMOS transistor. The first and second transistors operating with inputs and outputs between VVss and VVdd may consume excessive power. The twelfth and thirteenth transistors enable the first and second inverters only when the first and second inverters are used by the buffer to change the buffer output level, as described below.

The twelfth transistor M12 is turned-on when a fourth control signal CS4 is supplied. The result is that a voltage of the third voltage VVdd is supplied to the first inverter 127*a*, which is thereby enabled.

The thirteenth transistor M13 is turned-on when a fifth control signal CS5 is supplied. The result is that a voltage of the third voltage VVss is supplied to the second inverter 127*b*, which is thereby enabled.

Figure 8:
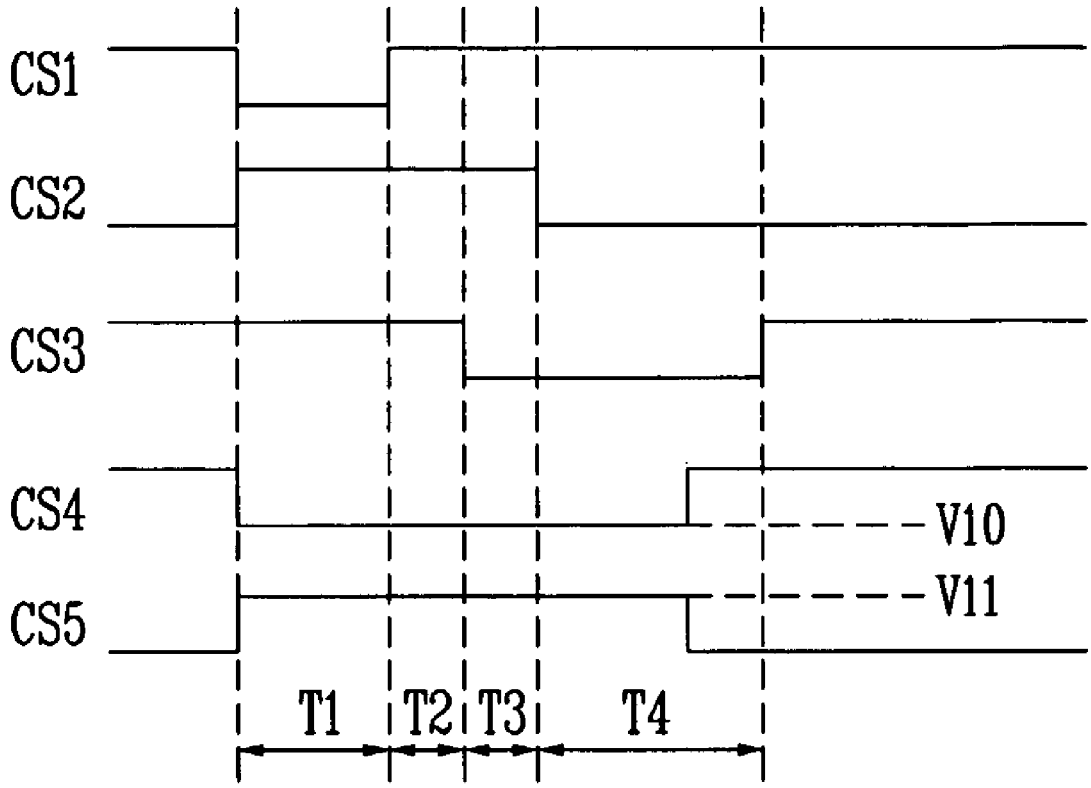
FIG. 8 is a timing diagram showing control signals supplied to the buffer depicted in FIG. 7.

Referring to FIGS. 7 and 8, the operation of the buffer will be explained. As shown in FIG. 8, prior to the first driving period T1, the first control signal CS1, the second control signal CS2, the third control signal CS3, the fourth control signal CS4 and the fifth control signal CS 5 are not active. Note that the first control signal CS1, the third control signal CS3, and the fourth control signal CS4 are active low as they are used to drive PMOS transistors, and, the second control signal CS2, and the fifth control signal CS5 are active high as they are used to drive NMOS transistors. From the first driving period T1 through the beginning fourth driving period T4, the fourth control signal CS4 and the fifth control signals CS5 are active. Therefore, the first inverter 127*a* and the second inverter 127*b* are each enabled from the first driving period T1 through the beginning fourth driving period T4. During these time periods the first through third control signals CS1-CS3 are driven in the same manner as the corresponding signals, which were discussed with reference to FIG. 4. Similarly, the operation of the buffer is the same as that which was discussed with reference to FIG. 4. Note, however, that during the fourth time period T4, once the voltage at the sixth node N6 is at VVdd, and the first transistor is off, the first and second inverters do not need to operate. The power they consume can be saved if they are disabled. Accordingly, after some time has passed in the fourth driving period T4, the fourth control signal CS4 is changed to a not active state, and the first inverter 127*a* is disabled. Similarly, the fifth control signal CS5 is changed to a not active state, and the second inverter 127*b* is disabled. Note that the circuit is configured to maintain the voltage at the sixth node N6 to be at least VVdd when the first and second inverters are disabled.

Figure 9A:
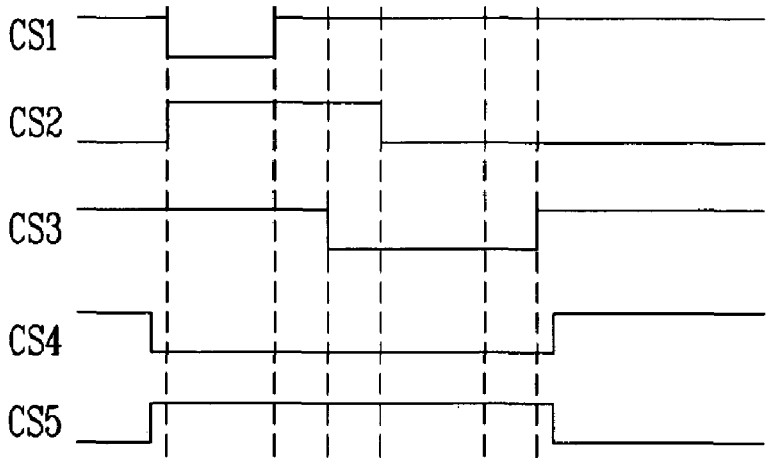
FIGS. 9*a* through 9*c* are timing diagrams showing control signals supplied to the buffer depicted in FIG. 7.
Figure 9B:
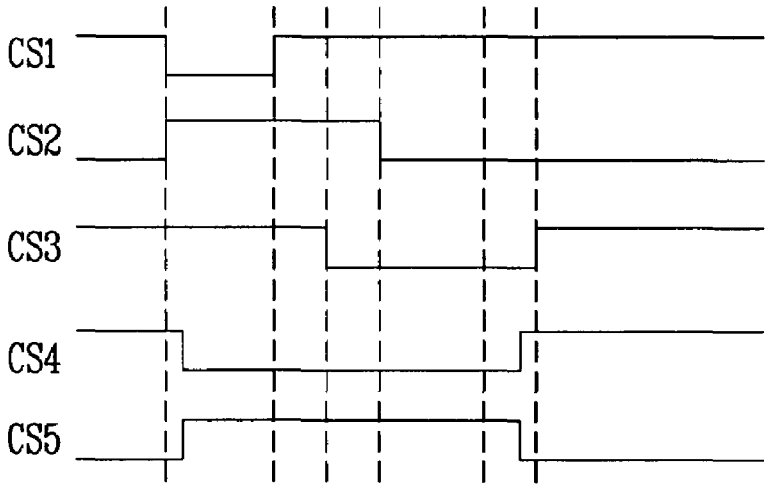
Figure 9C:
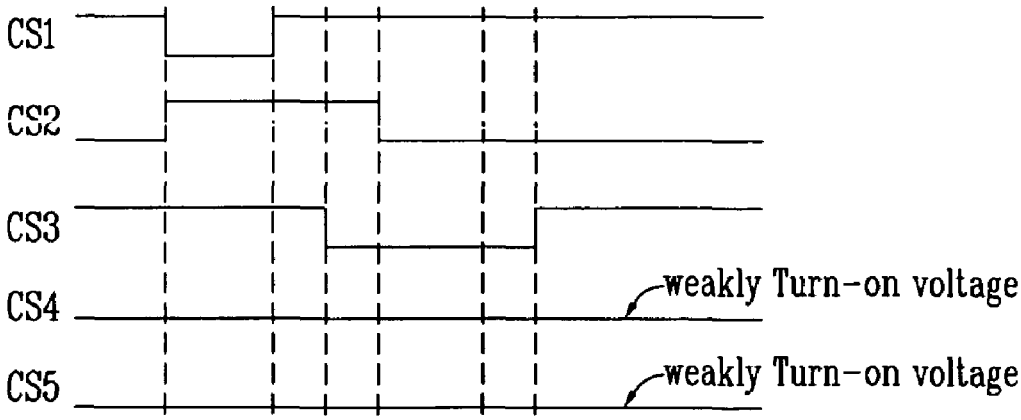

Other control signal driving schemes, such as those depicted in FIGS. 9A through 9C, may also be used. FIG. 9A shows a timing diagram where the fourth and fifth control signals CS4 and CS5 enable the first and second inverters throughout the first through fourth driving periods. Similarly, FIG. 9B shows a timing diagram where the fourth and fifth control signals CS4 and CS5 enable the first and second inverters throughout most of, but not all of the first through fourth driving periods.

FIG. 9C shows another type of driving strategy. In this strategy, the fourth and fifth control signals CS4 and CS5 enable the first and second inverters continually. However, the voltages at the fourth and fifth control signals CS4 and CS5 are selected so as to allow a limited amount of current to flow to the inverters, rather than being substantially equal to one of the voltages of the third or fourth power sources. In this way, the inverters are always on and operational, but are operating with limited current so as to save power.

As described above, a buffer and organic light emitting display with data driving circuit using the same in accordance with an exemplary embodiment of the present invention are able to provide an accurate analog voltage regardless of a threshold voltage of a transistor. Because the buffer is able to provide an accurate gradation voltage regardless of a threshold voltage of a transistor, the buffer may advantageously drive a panel having a large area and a high resolution. Also, because an enable voltage is selectively supplied such that the inverters operate only when used to change the buffer output voltage, power consumption can be reduced.

While the above description has pointed out novel features of the invention as applied to various embodiments, the skilled person will understand that various combinations, omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A buffer comprising:

a first capacitor comprising first and second capacitor terminals, the first capacitor being configured to receive an analog voltage on the first capacitor terminal, wherein the analog voltage is an input to the buffer;

a first inverter having a first input terminal and a first output terminal, the first input terminal being connected to the second capacitor terminal of the first capacitor;

a second capacitor having a third capacitor terminal connected to the first output terminal of the first inverter, and a fourth capacitor terminal;

a second inverter having a second input terminal and a second output terminal, the second input terminal being connected to the fourth capacitor terminal of the second capacitor;

a third capacitor having a fifth capacitor terminal connected to the second output terminal of the second inverter, and a sixth capacitor terminal;

a first transistor connected to the sixth capacitor terminal of the third capacitor, the first transistor being configured to control a flow of a current from a first power source to a data line such that a buffer voltage is supplied to the data line, wherein the first transistor is configured to control the current in response to a voltage supplied from the third capacitor; and a second transistor connected to the data line and to the first terminal of the first capacitor.

2. The buffer of claim 1, wherein the value of the buffer voltage is substantially equal to the value of the analog voltage input.

3. The buffer of claim 2, wherein the first transistor is configured to be turned off when the value of the buffer voltage is substantially equal to the value of the analog voltage input.

4. The buffer of claim 1, wherein the absolute value of the voltage supplied from the third capacitor to the first transistor is larger than the absolute value of the analog voltage input.

5. The buffer of claim 1, further comprising:

a third transistor connected to the first capacitor terminal of the first capacitor, the third transistor being configured to supply the analog voltage to the first capacitor terminal of the first capacitor when a first control signal is supplied to the third transistor;

a fourth transistor connected to the first power source and the sixth capacitor terminal of the third capacitor, the fourth transistor being configured to supply a voltage substantially equal to the voltage of the first power source to the third capacitor when the first control signal is supplied to the fourth transistor; and a fifth transistor connected to the data line and to a second power source, the fifth transistor being configured to supply the data line with the voltage of the second power source when a second control signal is supplied to the fifth transistor.

6. The buffer of claim 5, wherein the voltage of the first power source is higher than the voltage of the second power source.

7. The buffer of claim 5, further comprising:

a sixth transistor connected to the first output of the first inverter and to the first input of the first inverter, the sixth transistor configured to be turned on when the first control signal is supplied to the sixth transistor; and a seventh transistor connected to the second output of the second inverter and to the second input of the second inverter, the seventh transistor configured to be turned on when the first control signal is supplied to the seventh transistor.

8. The buffer of claim 7, wherein the second transistor is configured to be turned on when a third control signal is supplied.

9. The buffer of claim 8, wherein the buffer is configured to receive the start of the first control signal and the second control signal substantially simultaneously, and to receive the end of the first control signal earlier than the end of the second control signal.

10. The buffer of claim 9, wherein the buffer is configured to receive the start of the third control signal after the end of the first control signal and before the end of the second control signal, and to receive the end of the third control signal after the end of the second control signal.

11. The buffer of claim 10, further comprising:

an eighth transistor connected between the first inverter and the first power source; and a ninth transistor connected between the second inverter and the second power source.

12. The buffer of claim 11, wherein the eighth transistor and the ninth transistor are of different conductivity.

13. The buffer of claim 12, wherein the eighth transistor is configured to be turned on when a fourth control signal is supplied to the eighth transistor, and wherein the ninth transistor is configured to be turned on when a fifth control signal is supplied to the ninth transistor.

14. The buffer of claim 13, wherein the buffer is configured to receive the start of the fourth and fifth control signals before or substantially simultaneously with the second control signal and to receive the end of the fourth and fifth control signals after the start of the third control signal.

15. The buffer of claim 13, wherein the buffer is configured to receive fourth and fifth control signals each comprising at least one of a voltage substantially equal to the voltage of the first power source, a voltage substantially equal to the voltage of the second power source, and a voltage configured to provide a limited non-zero current to the first or second inverter.

16. The buffer of claim 13, configured to receive the fourth and fifth control signals continuously and to provide a first limited non-zero current to the first inverter and a second limited non-zero current to the second inverter in response to the fourth and fifth control signals.

17. A data driving circuit comprising:

a digital to analog converter configured to generate an analog voltage in response to a bit value of a data input; and a plurality of buffers each buffer configured to supply the analog voltage to a data line, each buffer comprising:

a first capacitor comprising first and second capacitor terminals, the first capacitor being configured to receive an analog voltage on the first capacitor terminal, wherein the analog voltage is an input to the buffer;

a first inverter having a first input terminal and a first output terminal, the first input terminal being connected to the second capacitor terminal of the first capacitor;

a second capacitor having a third capacitor terminal connected to the first output terminal of the first inverter, and a fourth capacitor terminal;

a second inverter having a second input terminal and a second output terminal, the second input terminal being connected to the fourth capacitor terminal of the second capacitor;

a third capacitor having a fifth capacitor terminal connected to the second output terminal of the second inverter, and a sixth capacitor terminal;

a first transistor connected to the sixth capacitor terminal of the third capacitor, the first transistor being configured to control a flow of a current from a first power source to a data line such that a buffer voltage is supplied to the data line, wherein the first transistor is configured to control the current in response to a voltage supplied from the third capacitor; and a second transistor connected to the data line and to the first terminal of the first capacitor.

18. The data driving circuit of claim 17, wherein the value of the buffer voltage is substantially equal to the value of the analog voltage input.

19. The data driving circuit of claim 18, wherein the first transistor is configured to be turned off when the value of the buffer voltage is substantially equal to the value of the analog voltage input.

20. The data driving circuit of claim 17, further comprising:

a third transistor connected to the first capacitor terminal of the first capacitor, the third transistor being configured to supply the analog voltage to the first capacitor terminal of the first capacitor when a first control signal is supplied to the third transistor;

a fourth transistor connected to the first power source and the sixth capacitor terminal of the third capacitor, the fourth transistor configured to supply a voltage substantially equal to the voltage of the first power source when the first control signal is supplied to the fourth transistor; and a fifth transistor connected to the data line and to a second power source, the fifth transistor configured to supply the voltage of the second power source to the data line when a second control signal is supplied to the fifth transistor.

21. The data driving circuit of claim 20, wherein the voltage of the first power source is higher than the voltage of the second power source.

22. The data driving circuit as claimed in claim 20, further comprising:

a sixth transistor connected to the first output of the first inverter and to the first input of the first inverter, the sixth transistor being configured to be turned on when the first control signal is supplied to the sixth transistor; and a seventh transistor connected to the second output of the second inverter and to the second input of the second inverter, the seventh transistor configured to be turned on when the first control signal is supplied to the seventh transistor.

23. The data driving circuit of claim 22, further comprising:

an eighth transistor being connected between the first inverter and the first power source; and a ninth transistor being connected between the second inverter and the second power source.

24. The data driving circuit of claim 23, wherein the eighth transistor and the ninth transistor are of different conductivity.

25. The data driving circuit of claim 23, wherein the eighth transistor is configured to be turned on when a fourth control signal is supplied to the eighth transistor, and the ninth transistor is configured to be turned on when a fifth control signal is supplied to the ninth transistor.

26. The data driving circuit of claim 17, further comprising:

a shift register configured to sequentially generate a sampling signal; and a latch section configured to store the data corresponding to the sampling signal and to supply the stored data to the digital to analog converter.

* * * * *

UNITED STATES PATENT AND TRADEMARK OFFICE

CERTIFICATE OF CORRECTION

PATENT NO. : 7,307,455 B2
APPLICATION NO. : 11/390774
DATED : December 11, 2007
INVENTOR(S) : Sang Moo Choi, Yong Sung Park and Yang Wan Kim It is certified that error appears in the above-identified patent and that said Letters Patent is hereby corrected as shown below:

Title Page; item (73);

Column 1, line 1, please delete “SDI” and insert -- SDI. --, therefore.

Column 4, line 49, please delete “DJ” and insert -- Dj --, therefore.

Column 8, line 17, please delete “Vvss.” and insert -- VVss. --, therefore.

Signed and Sealed this

Twelfth Day of August, 2008

JON W. DUDAS
*Director of the United States Patent and Trademark Office*